US006371095B1

(12) United States Patent
Sacarto

(10) Patent No.: US 6,371,095 B1
(45) Date of Patent: Apr. 16, 2002

(54) ULTRASOUND WHISTLES FOR INTERNAL COMBUSTION ENGINE

(76) Inventor: Walter E. Sacarto, 1413 S. Broadway, Denver, CO (US) 80210

( * ) Notice: Subject to any disclaimer, the term of this patent is extended or adjusted under 35 U.S.C. 154(b) by 0 days.

(21) Appl. No.: 09/643,025

(22) Filed: Aug. 21, 2000

Related U.S. Application Data

(60) Provisional application No. 60/150,213, filed on Aug. 23, 1999.

(51) Int. Cl.[7] ..... F02M 29/00
(52) U.S. Cl. ..... 123/590
(58) Field of Search ..... 123/590

(56) References Cited

U.S. PATENT DOCUMENTS 3,857,375 A * 12/1974 Jackson ..... 123/587
4,476,817 A * 10/1984 Lindberg ..... 123/3
5,950,585 A * 9/1999 Sarcarto ..... 123/169 R

* cited by examiner

*Primary Examiner*—Noah P. Kamen
(74) *Attorney, Agent, or Firm*—Edwin H. Crabtree; Ramon L. Pizarro; Donald W. Margolis

(57) ABSTRACT

A plurality of ultrasound engine whistles used in an internal combustion engine. The whistles may be placed inside a carburetor, inside a cylinder head, around an engine valve stem and other locations inside the engine. The whistles provide for greatly improved air fuel mixture prior to ignition. Also, the whistles allow for increased engine performance and acceleration, improved fuel mileage and a cleaner burning air fuel mixture for reduced fuel emissions into the environment. The ultrasound whistles include a whistle body having a first end portion and a second end portion. A whistle hole with whistle lip therearound is formed in the first end portion of the whistle body. The whistle hole has a depth in a range of 0.032 to 0.050 inches. Also, the whistle hole has a diameter in a range of 0.031 to 0.033 inches. The whistles may have various lengths in a range of ⅛ inch to 1 inch and longer depending on the application inside the engine. The whistles help create a greater and more homogenous and atomized air fuel mixture prior to ignition in the engine cylinder.

16 Claims, 2 Drawing Sheets

ULTRASOUND WHISTLES FOR INTERNAL COMBUSTION ENGINE

This application is based on a provisional patent application filed in the U.S. Patent and Trademark office on Aug. 23, 1999 and having serial No. 60/150,213 by the subject inventor, Walter E. Sacarto.

BACKGROUND OF THE INVENTION (a) Field of the Invention

This invention relates to whistles used for improving air fuel mixtures and more particularly, but not by way of limitation, to ultrasound whistles used in an internal combustion engine for improving air fuel mixture prior to ignition.

(b) Discussion of Prior Art

In U.S. Pat. No. 3,143,401 to Lambrecht, U.S. Pat. No. 3,544,290 to Larson et al., U.S. Pat. No. 3,720,290 to Lansky et al., U.S. Pat. No. 3,730,160 to Hughes, U.S. Pat. No. 3,829,015 to Monro, U.S. Pat. No. 5,477,822 to Haghgooie et al., U.S. Pat. No. 3,857,375 to Jackson and U.S. Pat. No. 3,914,353 to Cherry various types of ultrasonic fuel injection devices and atomizing fuel inventions are described. None of these prior art patents disclose or teach the use of ultrasound whistles disposed inside a internal combustion engine for improved engine performance and added benefits described herein.

In a text book published by McGraw Hill, 1960, titled "Whistle Ultrasonics" by Benson Carlin, whistle type ultrasound is described operating in a range of 5000 to 10,000 cycles per second. The frequency wave length for ultrasound is 8 inches in solid material, 2.4 inches in liquids and approximately 0.63 inches in atmospheric air. The type of wave produced by whistles are longitudinal and "L" waves. An ultrasonic wave in an air fuel mixture starts out as a longitudinal wave and when it strikes particles of fuel, it turns into a "L" wave. The more particles of fuel the "L" wave hits, the more excited it becomes. When the "L" wave strikes the side of a spark plug and any other metal surface in it's path, the wave is amplified twice. The more surfaces the ultrasound wave strikes, the greater the acceleration. When sound waves are traveling through various mediums, the waves are reflected, refracted, defracted, scattered and multiplied. Like any whistle sound, the more air that crosses the whistle, the more the volume it produces. Today, ultrasound is used in a variety of industries for cleaning, metal testing and like applications.

SUMMARY OF THE INVENTION

In view of the foregoing, it is a primary object of the subject invention to provide a internal combustion engine with ultrasound whistles for greatly improved air fuel mixture prior to ignition. The whistles can be used in gasoline and diesel engines along with natural gas engines.

Another object of the invention is the ultrasound whistles provide for increased engine performance and acceleration and improved fuel mileage.

Still another object of the engine whistles is to provide a cleaner burning air fuel mixture thereby providing for reduced fuel emissions into the environment. Also, the whistles help create a greater and more homogenous air fuel mixture prior to ignition in the engine cylinder.

Yet another object of the invention is the whistles may be installed inside a carburetor, inside a cylinder head, around an engine valve stem and other locations inside the engine.

The subject ultrasound whistles include a whistle body having a first end portion and a second end portion. A whistle hole with whistle lip therearound is formed in the first end portion of the whistle body. The whistle hole has a depth in a range of 0.032 to 0.050 inches. Also, the whistle hole has a diameter in a range of 0.031 to 0.033 inches. The whistles may have various lengths in a range of ⅛ inch to 1 inch and longer depending on the application inside the engine. The whistles help create a greater and more homogenous and atomized air fuel mixture prior to ignition in the engine cylinder.

These and other objects of the present invention will become apparent to those familiar air fuel mixtures in an internal combustion engine, the use of ultrasound and whistles operating in an ultrasound range of 5000 cycles per second and greater when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
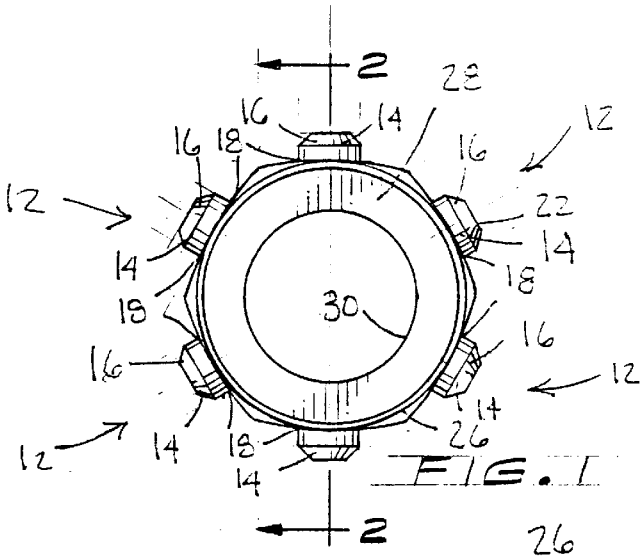
FIG. 1 is a greatly enlarged top view of a plurality of ultrasound whistles mounted on an outer circumference of whistle ring. The whistle ring has inner circumference adapted for receipt around a valve stem.

In FIG. 1, a plurality of ultrasound whistles are shown having general reference numeral 12. The whistles 12 include a whistle body 14 having a first end portion 16 and a second end portion 18. A whistle hole 20 with a whistle lip 22 therearound is formed in the first end portion 16. The whistle hole 20 The whistle lip 22 is shown with a beveled edge 24. The second end portion 18 is attached to an outer circumference 26 of a whistle ring 28. The whistle ring 28 has inner circumference 30 which is adapted for receipt around a valve stem 32. The valve stem 32 is shown in FIG.

Figure 2:
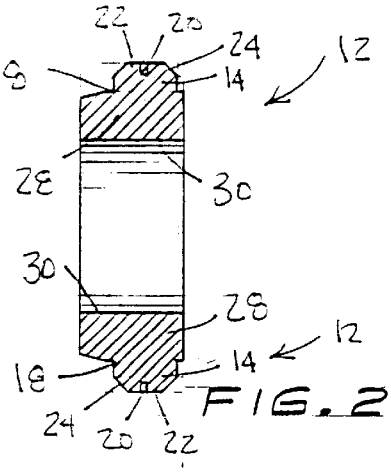
FIG. 2 is sectional view of the whistle ring with ultrasound whistles taken along lines 2—2 shown in FIG. 1.

In FIG. 2, a sectional view of the whistle ring 28 is shown with ultrasound whistles 12 taken along lines 2—2 shown in FIG. 1. In this view, the whistle holes 20 with whistle lips 22 are shown in the first end portion 16 of the whistle body 14. The whistle holes 20 have a depth in a range of 0.032 to 0.050 inches. Also, the whistle hole 20 have a diameter in a range of 0.031 to 0.033 inches. The whistles 12 may have various lengths in a range of ⅛ inch to 1 inch and longer depending on the application inside the engine. In this example, the whistles 12 when mounted on a whistle ring 28 may be only ⅛ to ¼ inches in length.

Figure 3:
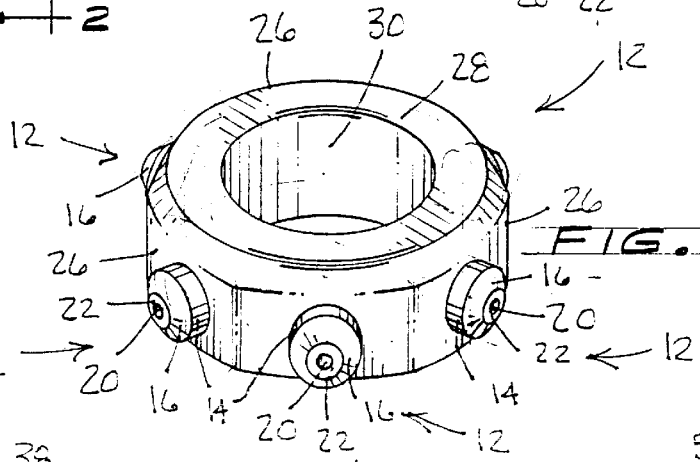
FIG. 3 is a perspective view of the whistle ring with ultrasound whistles shown in FIG. 1.

In FIG. 3, a perspective view of the whistle ring 28 is shown. In this drawing, a plurality of ultra sound whistles 12 are illustrated spaced equally around the outer circumference 26 of the whistle ring 28. In this view, the whistle holes 20 with whistle lips 22 can be seen in the first end portion 16 of the whistle body 14.

Figure 4:
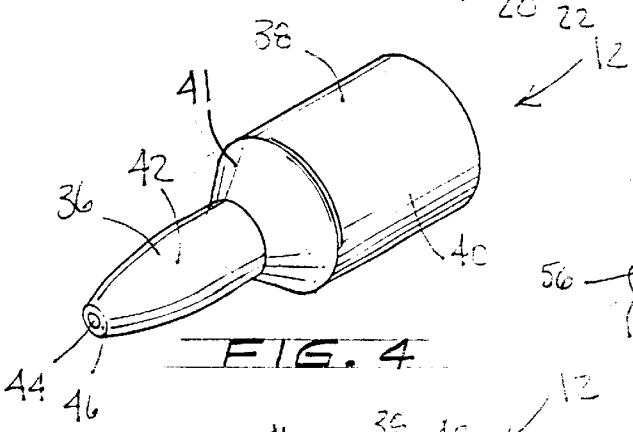
FIG. 4 is an enlarged perspective view of another embodiment of the subject ultrasound whistle having a whistle stem with an outwardly extending whistle nose and whistle hole in the end thereof.

In FIG. 4, a perspective view of another embodiment of the ultrasound whistle 12 is shown. In this drawing, the whistle 12 includes a whistle body 34 with a first end portion 36 and a second end portion 38. The second end portion 38 includes a whistle stem 40. The first end portion 36 includes a downwardly formed beveled portion 41 and an outwardly extending bullet shaped whistle nose 42. A whistle hole 44 is formed in the end of the first end portion 36. Surrounding the whistle hole 44 is a whistle lip 46.

Figure 5:
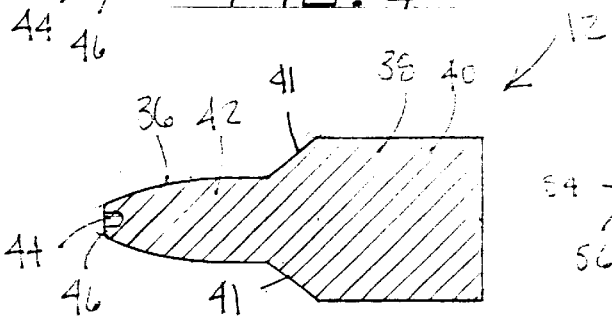
FIG. 5 is a sectional view of the ultrasound whistle shown in FIG. 4.

In FIG. 5, a sectional view of the ultrasound whistle 12 is illustrated as shown in FIG. 4. In this view, the whistle stem 40 is shown tapered downwardly, from right to left, where it merges into the bullet shaped whistle nose 42 formed in the first end portion 36. Also shown in this drawing is the whistle hole 44 formed in the end of the first end portion 36.

Figure 6:
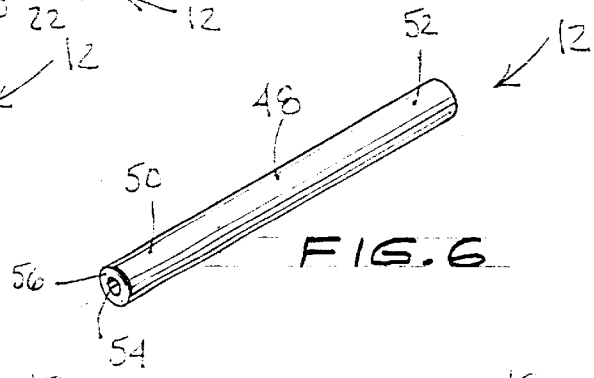
FIG. 6 is an enlarged perspective view of still another embodiment of the subject ultrasound whistle having an elongated whistle body with one end having a whistle hole therein and a whistle lip around the whistle hole.

In FIG. 6, a perspective view of still another embodiment of the ultrasound whistle 12 is shown having an elongated whistle body 48 having a first end portion 50 and a second end portion 52. The first end portion 50 includes a whistle hole 54 therein and a whistle lip 56 around the whistle hole 54.

Figure 7:
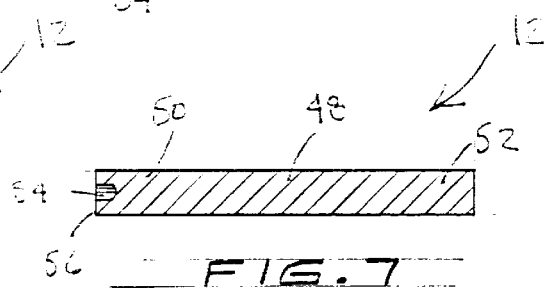
FIG. 7 is a sectional view of the ultrasound whistle shown in FIG. 6.

In FIG. 7, a sectional view of the ultrasound whistle 12 is shown. In this drawing, the whistle hole 54 is shown extending inwardly in the first end portion 50 with the whistle lip 56 therearound. As mentioned above, the whistle holes may have a depth in a range of 0.032 to 0.050 inches and a diameter in a range of 0.031 to 0.033 inches. Also, the whistle 12 shown in this drawings may have a length in a range of ½ to 1 inch or longer.

Figure 8:
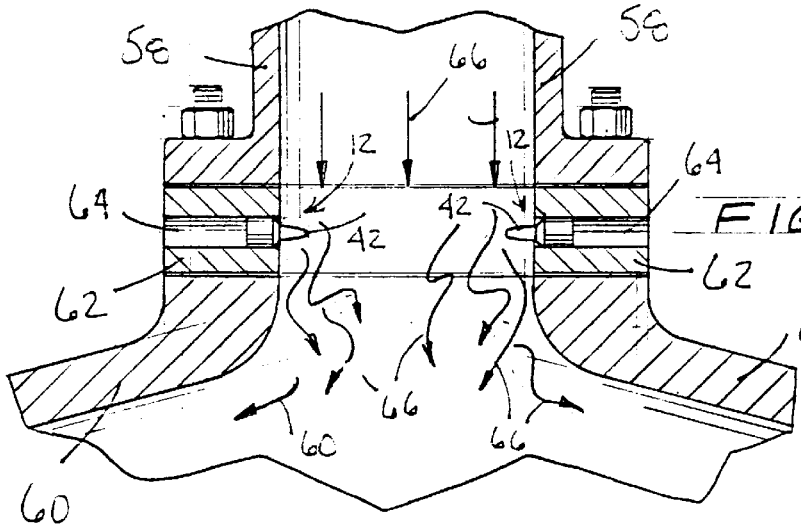
FIG. 8 is a sectional view of a portion of a carburetor, a spacer and a portion of an intake manifold. In this drawing, two of the ultrasound whistles shown in FIG.4 are shown mounted in drilled bores in the spacer with the nose of the whistle extending into the air fuel mixture path inside the carburetor.

In FIG. 8, a sectional view of a lower portion of a carburetor 58, an upper portion of an intake manifold 60 and a spacer 62 mounted therebetween is shown. In this drawing, two of the ultrasound whistles 12, shown in FIG.4, are mounted in drilled bores 64 in the spacer 62. The whistle nose 42 of the whistle 12 is extended into an air fuel mixture chamber 66 which extends from the carburetor 58, through the spacer 62 and into the intake manifold 60. An air fuel mixture is indicated by straight and curved arrows 66. As the air fuel mixture 66 passes downwardly past the whistle hole 44 in the whistle nose 42, the mixture 66, shown as caved arrows, is homogenous and atomized for greatly improving the mixture of the fuel in the air and prior to ignition in the engine.

Figure 9:
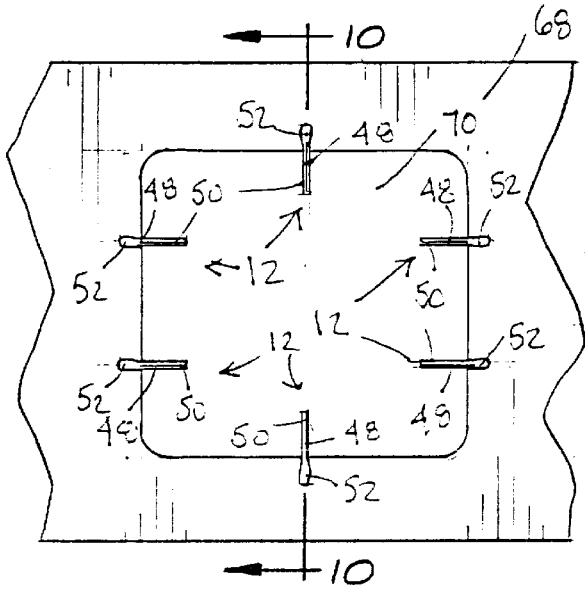
FIG. 9 is a top view of a plurality of ultrasound whistles, as shown in FIG. 6, mounted around the sides of a cylinder head.

In FIG. 9, a top view of a plurality of ultrasound whistles 12, as shown in FIG. 6, are illustrated mounted and spaced around the sides of a cylinder head 68. In this example, the second end portion 52 of the elongated whistle body 48 is spot welded to the sides of the cylinder head 68. The first end portion 50 of the whistles 12 extends outwardly into a cylinder head opening 70.

Figure 10:
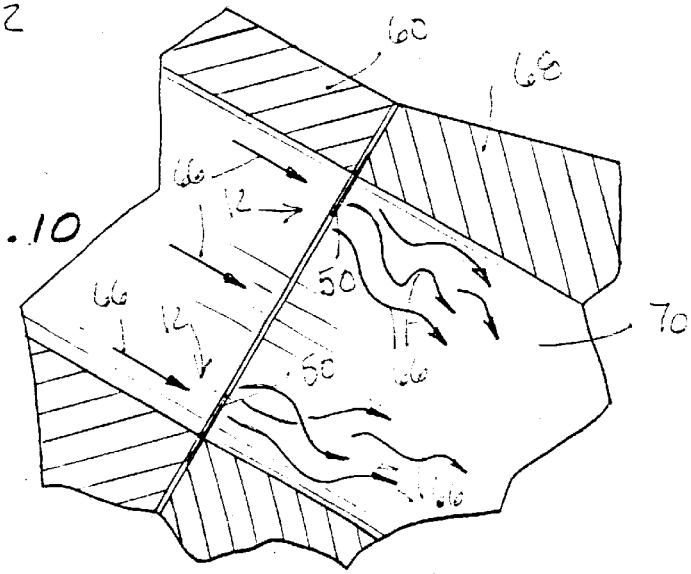
FIG. 10 is a sectional view of the cylinder head taken along lines 10—10 shown in FIG. 9.

In FIG. 10, a sectional view of an upper portion of the cylinder head 68 is shown taken along lines 10—10 shown in FIG. 9. Also shown in this drawing is a lower portion of the intake manifold 60. In this view, the air fuel mixture, shown as straight arrows 66, move downwardly past the whistle holes 54 in the first end portion 50 of the whistles 12. Once the air fuel mixture 66 has moved past the whistle 12 into the upper portion of the cylinder head opening 70, the air fuel mixture is accelerated and the fuel is homogenized with the air for improved engine performance and acceleration.

Figure 11:
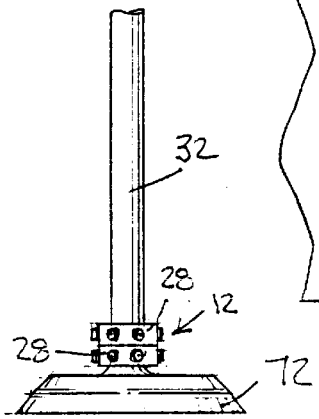
FIG. 11 is a side view of a valve stem with a pair of the whistle rings, shown in FIG. 3, received around a portion of the valve stem.

In FIG. 11, a side view of the valve stem 32 is shown with whistles 12 mounted on whistle rings 28, as shown in FIG. 3. In this view, a pair of whistle rings 28 are received around the valve stem 32. The whistles 12 with whistle holes 20 are used for improving the air fuel mixture received next to a engine valve 72 attached to one end of the valve stem 32.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An ultrasound engine whistle for use inside an internal combustion engine, the whistle may be placed inside a carburetor, inside a cylinder head, around an engine valve stem and other locations inside the engine, the engine whistle comprising:

a whistle body having a first end portion and a second end portion;

a whistle hole formed in the first end portion of said whistle body; and a whistle lip disposed around said whistle hole, said whistle lip having a beveled edge therearound.

2. The engine whistle as described in claim 1 wherein said whistle hole has a depth in a range of 0.032 to 0.050 inches in the first end portion of said whistle body.

3. The engine whistle as described in claim 1 wherein said whistle hole has a diameter in a range of 0.031 to 0.033 inches in the first end portion of said whistle body.

4. The engine whistle as described in claim 1 wherein said whistle body has a length in arrange of ⅛ inch to 1 inch.

5. The engine whistle as described in claim 1 further including a whistle ring, the second end portion of said whistle body attached to said whistle ring and extending outwardly therefrom.

6. The engine whistle as described in claim 5 further including a plurality of whistle bodies, the second end portion of said whistle bodies attached to and disposed around an outer circumference of said whistle ring.

7. An ultrasound engine whistle for use inside an internal combustion engine, the whistle may be placed inside a carburetor, inside a cylinder head, around an engine valve stem and other locations inside the engine, the engine whistle comprising:

a plurality of whistle bodies, said whistle bodies having a first end portion and a second end portion;

a whistle hole formed in the first end portion of said whistle bodies; and a whistle lip disposed around said whistle hole, said whistle lip having a beveled edge; and a whistle ring, the second end portion of said whistle bodies attached to an outer circumference of said whistle ring, said whistle ring having an inner circumference adapted for receipt around a valve stem.

8. The engine whistle as described in claim 7 wherein said whistle bodies are equally spaced around the outer circumference of said whistle body.

9. The engine whistle as described in claim 7 wherein said whistle bodies have a length in a range of ⅛ inch to 1 inch.

10. The engine whistle as described in claim 7 wherein the second end portions of said whistle bodies are adapted for attachment around sides of a cylinder head, the first end portions of said whistle bodies extending outwardly into a cylinder head opening.

11. An ultrasound engine whistle for use inside an internal combustion engine, the whistle may be placed inside a carburetor, inside a cylinder head, around an engine valve stem and other locations inside the engine, the engine whistle comprising:

a whistle body, said whistle body having a first end portion and a second end portion, the second end portion having a whistle stem, the first end portion having a downwardly formed beveled portion and an outwardly extending bullet shaped whistle nose, a whistle hole formed in said bullet shaped whistle nose; and a whistle lip disposed around said whistle hole, said whistle lip having a beveled edge therearound.

12. The engine whistle as described in claim 11 further including a plurality of whistle bodies.

13. The engine whistle as described in claim 12 wherein said whistle bodies have a length in a range of ⅛ inch to 1 inch.

14. The engine whistle as described in claim 12 wherein the second end portion of said whistle bodies are adapted for attachment to sides of a spacer next to an intake manifold, said first end portion of said whistle bodies adapted for receipt into an air fuel mixture chamber.

15. The engine whistle as described in claim 11 wherein said whistle hole has a depth in a range of 0.032 to 0.050 inches.

16. The engine whistle as described in claim 11 wherein said whistle hole has a diameter in a range of 0.031 to 0.033 inches.

* * * * *